United States Patent [19]

Schüler

[11] Patent Number: 4,821,521

[45] Date of Patent: Apr. 18, 1989

[54] POSITIONING DRIVE FOR A MOTOR VEHICLE DOOR CLOSING DEVICE

[75] Inventor: Rolf Schüler, Heiligenhaus, Fed. Rep. of Germany

[73] Assignee: Kiekert GmbH & Co. Kommanditgesellschaft, Heiligenhaus, Fed. Rep. of Germany

[21] Appl. No.: 71,625

[22] Filed: Jul. 9, 1987

[30] Foreign Application Priority Data

Aug. 12, 1986 [DE] Fed. Rep. of Germany ... 8621592[U]

[51] Int. Cl.[4] ..... E05C 3/06; E05B 37/20

[52] U.S. Cl. ..... 60/716; 292/144; 292/201; 292/216; 70/279; 70/282

[58] Field of Search ..... 60/716; 292/144, 201, 292/216; 70/279, 282

[56] References Cited

U.S. PATENT DOCUMENTS 4,624,491 11/1986 Vincent ..... 292/201

4,708,378 11/1987 Ingenhoven ..... 292/201

*Primary Examiner*—Allen M. Ostrager

*Attorney, Agent, or Firm*—Herbert Dubno

[57] ABSTRACT

The positioning drive for a motor vehicle door closing device, particularly for a motor vehicle central locking mechanism, comprises an electric motor, a transmission, a gear/spindle unit and a positioning element all mounted in a housing. The positioning element is extendible and retractable by alternating action with the spindle. So that the positioning element can be moved back to its initial position without operation of the motor or application of a external manual force a spring extensible by a rotary motion is mounted in the transmission. It is attached with one end on a rotatable transmission component and braced or supported with the other end on the housing. This spring is extensible by the electric motor with the extension or retraction of the positioning element. The positioning element is returnable to its initial position by operation of the spring after the electric motor is shut off.

5 Claims, 2 Drawing Sheets

POSITIONING DRIVE FOR A MOTOR VEHICLE DOOR CLOSING DEVICE

FIELD OF THE INVENTION

My present invention relates to a positioning drive for a motor vehicle door closing device or door closer, particularly for a motor vehicle central locking mechanism.

BACKGROUND OF THE INVENTION

A positioning drive for a motor vehicle door closing device, particularly for a motor vehicle central locking mechanism, can comprise an electric motor, a transmission, a gear/spindle unit and a positioning element mounted in a housing. The positioning element is extendible and retractable by alternating action of the gear/spindle unit.

The positioning element is for example connected to the operating lever of a motor vehicle door closing device and positions it in the locked position or the theft preventing position.

In the known positioning drive the positioning element is extendible with the help of an electric motor and retractable also by reversing the poles of the motor. To this aspect the positioning drive is a servo controlling the lock mechanism or a slave system responsive to a master control.

According to the mechanism of the motor vehicle door closing device this can be a problem. It is a drawback, for example, in the case when a motor vehicle door closing device locked by the central locking mechanism should be opened manually from the vehicle interior. Then the positioning element must be returned by manual force using the appropriate device on the motor vehicle door closing device in synchronization with the transmission and the electric motor. In other applications of this positioning drive the conditions are similar when a kimenatic reversal in regard to extension and retraction is required.

OBJECTS OF THE INVENTION

It is an object of my invention to provide an improved positioning drive for a motor vehicle door closing device which obviates drawbacks of earlier systems.

It is also an object of my invention to provide an improved positioning drive for a motor vehicle door closing device in which the positioning element can be returned to its initial position without operation of the electric motor and without manual application of an external force.

SUMMARY OF THE INVENTION

These objects and others which will become more readily apparent hereinafter are attained in accordance with my invention in a positioning drive for a motor vehicle door closing device, particularly for a motor vehicle central locking mechanism, comprising an electric motor, a transmission, a gear/spindle unit and a positioning element mounted in a housing. The positioning element is extendible and retractable by alternating action of the gear/spindle unit.

According to my invention a force-storing spring extensible by a rotary motion is mounted in the transmission It is attached at one end to a rotatable transmission component and braced or supported with the other end on the housing. This spring is stressable by the electric motor during the retraction or extension of the positioning element and the positioning element is returned to its starting position by the spring after shut off of the electric motor.

This can be accomplished in several different ways. In one case the spring in a very elegant way is built into the transmission by providing the transmission with a gear shaped like a cup and the spring is mounted in it. The spring is attached to it with the one end mentioned above. The spring can be a coil or spiral spring. To fix the end of the spring not attached with the transmission in position it is braced or supported with a stressing disk on the housing.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
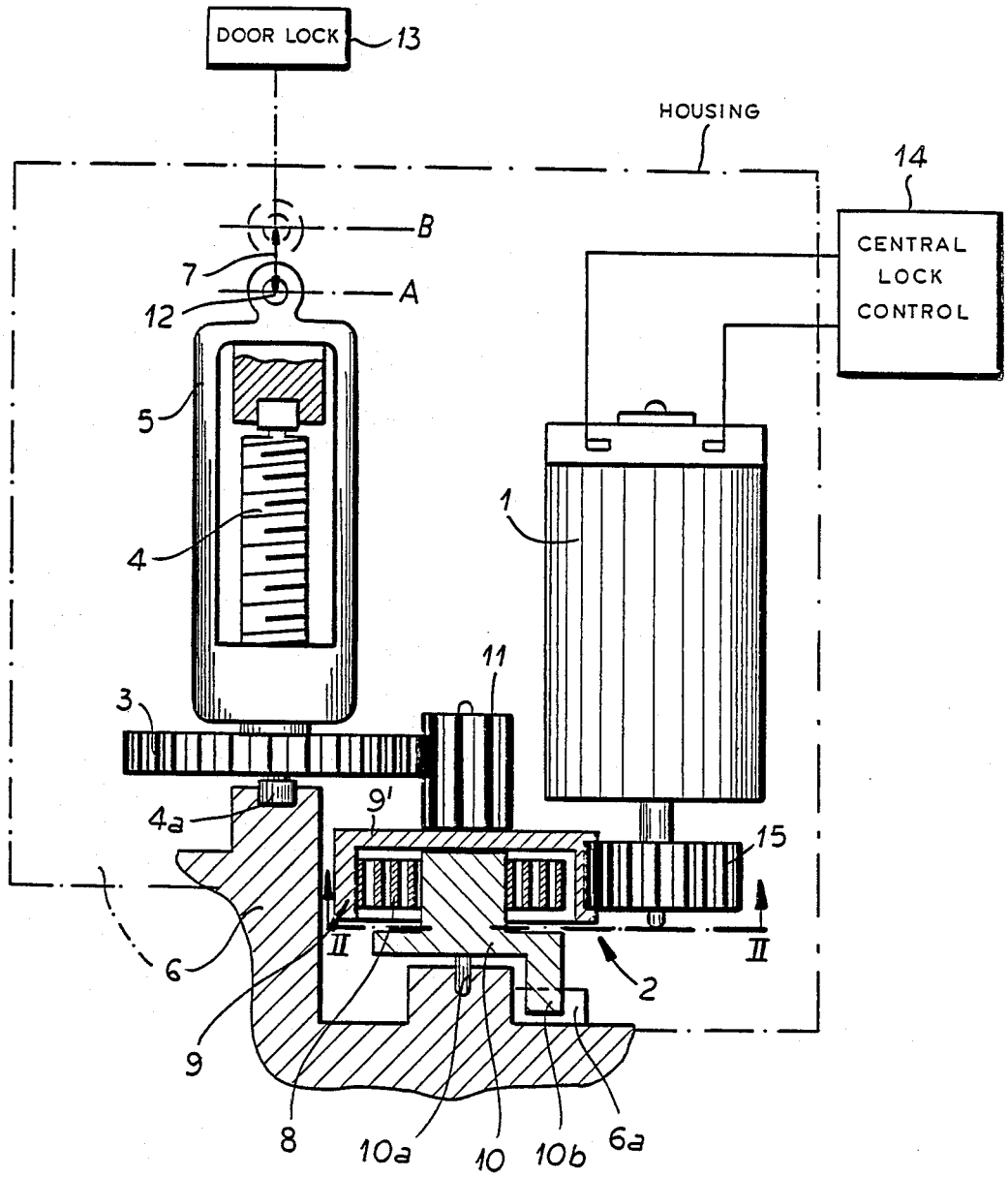
FIG. 1 is a side elevational view, partially broken away, of a positioning drive for a motor vehicle door closing device according to my invention.

The positioning drive shown in the FIG. 1 is designed for a motor vehicle door closing device. This may be a part of a central locking mechanism for the vehicle. This positioning drive comprises an electric motor 1, a transmission 2, a gear/spindle unit 3,4 and a positioning element 5.

The above mentioned components are located in a housing 6 of which only a small portion is shown. The positioning element 5 is extendible and retractable (or movable up and down) in the direction of the indicating double arrow 7 by a direct or indirect alternating action of the spindle 4.

Element 5 is connected to the respective door lock mechanism 13. The spindle 4 is threaded and is journaled on the housing at 4*a*. The element 5 forms a nut which threadedly engages the spindle and thus is driven upwardly or downwardly as the spindle 4 is rotatd in one or another sense. The element 5 is held against rotation by means not shown.

Figure 2:
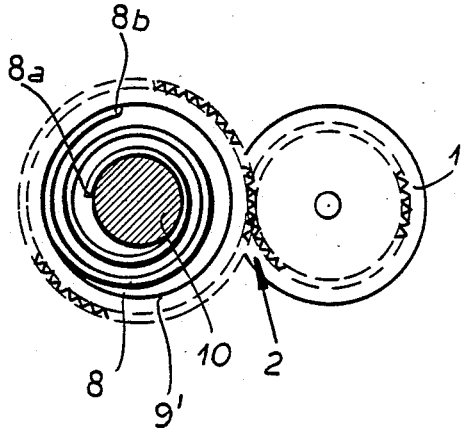
FIG. 2 is a section along line II—II of FIG. 1.

A spring 8 is mounted in the transmission 2. This is stressable by a rotation or pivotal motion. The spring 8, seen in FIGS. 1 and 2, is a spiral spring which is attached at one end 8*b* to a rotatable transmission component 9 and is braced or supported with the other end 8*a* directly or indirectly on the housing 6.

The structure of this embodiment is such that the spring 8 is stressable with the extension and retraction of the positioning element 5 by the electric motor 1.

On the other hand the positioning element 5 can be returned by the force stored in the stressed spring 8 after shut off of the electric motor 1. The rotatable transmission component 9 forms a gear 9' which is shaped like a cup. The spring 8 is mounted in the recess of the cup gear 9' and is attached with its one end 8*b* to it.

The end of the spring 8 not attached to the gear 9' is braced or supported with a stressing disk 10 on the housing 6.

When the voltage is applied to the electric motor 1 by the central lock control 14, a pinion 11 for the stepdown transmission stage formed by the meshing gears 3 and 11, and mounted on the gear 9', drives the spindle 4. The rotation of the spindle 4 engaged by the positioning element 5 is converted into a translational motion of the connection point 12 from position A to position B or from B to A, opposing a force. A further stage of the transmission is formed by the pinion 15 of the motor, meshing with gear 9'.

During this process, the spiral spring 8 connected at its end **8*a* to the housing 6 by a stressing disk 10 and its other end 8*b* to the gear 9' is stressed and thus a portion of the electrical energy fed to the electric motor 1** is stored as mechanical energy.

The disk 10 is rotatable on a pin **10*a* anchored in the housing 6 and forming a journal for the coupled gears 11 and 9'. The disk 10, however, has a finger 10*b*, which is engaged in radial slot 6a** of the housing to prevent rotation of this disk.

On shut off of the voltage to the electric motor 1 the energy stored in the coil spring 8 and/or the torque caused by it effect a rotation of the gears, the motor armature and the other moving parts of the transmission opposite to the direction of the aforementioned rotation.

Thus the connection point 12 is moved in the opposite direction from the aforementioned translational motion direction. Not only is no exterior force in the motion direction required but a motion of the connection point 12 inspite of a force opposing the motion occurs according to the design of the components of the drive.

Figure 3:
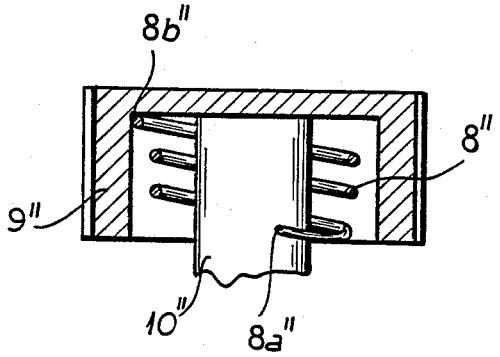
FIG. 3 is a view in section corresponding to FIG. 1 of another embodiment.

In FIG. 3 I have shown another spring arrangement which can be used. Here the spring 8'' is a helical spring anchored at **8*b*'' to the cup-shaped gear 9'' and at 8*a*'' to the disk 10''**.

I claim:

1. A positioning drive for a motor vehicle door closing device, particularly for a motor vehicle central locking mechanism, comprising:

a housing;

an electric motor mounted in said housing;

a transmission including a gear shaped like a cup and a coil spring mounted in said gear with one end attached to said gear and braced with the other end on said housing and being stressable by rotation, said transmission being mounted in said housing and connected to and driven by said electric motor;

a gear/spindle unit engaged with said transmission and mounted in said housing; and a positioning element mounted in said housing extendible and retractable by alternating action of said spindle so that said coil spring is stressable by rotation by said electric motor with the extension and retraction of said positioning element and said positioning element is returnable by said coil spring after shutting off said electric motor.

2. A positioning drive for a motor vehicle door closing device, particularly for a motor vehicle central locking mechanism, comprising:

a housing;

an electric motor mounted in said housing;

a transmission mounted in said housing and engaged with said motor;

a threaded spindle unit rotatably mounted in said housing and driven by said transmission;

a threaded positioning element mounted on said spindle and axially displaceable therealong by the rotation of said spindle; and a spring stressable by rotary motion mounted on said transmission and connected at one end to a rotatable component thereof, the other end of said spring connected to said housing and stressed by said transmission when said transmission is driven by said motor for the displacement of said positioning element in one direction, said positioning element being returnable from the displaced position by said stressed spring acting on said transmission when said motor is off, said transmission including a gear formed with an annular cuplike recess and said spring is disposed in said recess with said one end connected to said gear.

3. The positioning drive defined in claim 2 wherein said spring is formed as a helix.

4. The positioning drive defined in claim 2 wherein said spring is formed as a spiral.

5. The positioning drive defined in claim 2, further comprising a disk mounted on said housing, said other end of said spring being connected to said disk.

* * * * *